US005706018A

United States Patent [19]

Yankielun

[11] Patent Number: 5,706,018

[45] Date of Patent: Jan. 6, 1998

[54] MULTI-BAND, VARIABLE, HIGH-FREQUENCY ANTENNA

[76] Inventor: Norbert E. Yankielun, 54 Nottingham Cir., Lebanon, N.H. 03766

[21] Appl. No.: 668,190

[22] Filed: Jun. 21, 1996

[51] Int. Cl.[6] ..... H01Q 9/16; H01Q 9/14

[52] U.S. Cl. ..... 343/823; 343/897

[58] Field of Search ..... 343/823, 802, 343/793, 807, 894, 897; H01Q 9/16, 9/14

[56] References Cited

U.S. PATENT DOCUMENTS

| | | | |
|---|---|---|---|
| 2,613,319 | 10/1952 | Lisbin et al. | 250/33 |
| 3,025,524 | 3/1962 | Thies | 343/823 |
| 3,052,883 | 9/1962 | Rogers | 343/802 |
| 3,299,431 | 1/1967 | Hoblin | 343/823 |
| 3,419,869 | 12/1968 | Altmayer | 343/703 |
| 3,623,113 | 11/1971 | Faigen et al. | 343/747 |
| 3,818,488 | 6/1974 | Majkrzak et al. | 343/709 |
| 3,858,220 | 12/1974 | Arnow | 343/802 |
| 5,168,279 | 12/1992 | Knight | 343/703 |
| 5,554,997 | 9/1996 | Cobb | 343/897 |

*Primary Examiner*—Hoanganh T. Le
*Attorney, Agent, or Firm*—Luther A. Marsh

[57] ABSTRACT

A multi-band, variable, high-frequency antenna comprises a pair of transmission lines for conveyance of signals from and to a transceiver, and a pair of braided copper conductor elements, each in electrical communication at a proximal end thereof with one of the transmission lines. Each of the braided copper conductor elements is mounted on a non-conductive support cord, the braided copper conductor elements being expandable and retractable along the support cords on which the conductor elements are mounted. A cord lock is proximate a distal end of each of the conductor elements for releasably locking the distal end of the conductor element at a selected position on the support cord on which the conductor element is mounted. Release of the cord locks permits lengthening and shortening of the braided copper conductor elements, and locking of the cord locks is operative to lock the conductor elements in place on the support cords to selectively fix a length of each of the conductor elements.

4 Claims, 5 Drawing Sheets

MULTI-BAND, VARIABLE, HIGH-FREQUENCY ANTENNA

BACKGROUND OF THE INVENTION (1) Field of the Invention

The invention relates to radio antennas and is directed more particularly to a high-frequency antenna.

(2) Description of the Prior Art

Radio communications in the high-frequency (HF) band, defined as 3 to 30 MHz, frequently employs a resonant half-wave dipole antenna A (FIG. 1). This antenna design is widely known and described in the literature. The length of the conductive elements C of this type of antenna must be dimensioned precisely to resonate efficiently on one specific frequency. This is a drawback if a wide range of operating frequencies is desired. A dipole antenna, dimensioned to be resonant at a specific frequency, will operate satisfactorily over a very narrow bandwidth, on the order of 10 kHz. This bandwidth is not sufficient for radio communications applications in which the ability to switch between widely separated frequencies is desired.

The relationship between frequency and free-space wavelength λ, is:

$$\lambda(m)=c/f \quad (1)$$

where

=speed of radio waves in a vacuum=$3(10^8)$m/s f=frequency in Hz.

The actual length of a resonant half-wave dipole conductive element C is slightly less than one half of the free-space wavelength. This shortening of the conductive element C, relative to the calculated free-space dimension, is due to a slightly slower propagation velocity in the conductive element than in free-space and is related to the thickness of the conductive element C as compared to the operating wavelength. The greater the ratio of the conductive element length to the conductive element diameter, the closer to the dimensions as dictated by the free-space relationship. The propagation velocity is lessened by the velocity factor, k., which typically ranges from 0.92 to 0.98.

Resonant dipole antenna conductive element length $$(m)=(½)*(c*k/f) \quad (2)$$

Some additional shortening of the conductive element from the free-space derived dimension can be attributed to the end effects caused by the insulators and supporting hardware. The precise dimensions of the conductive element are also affected by surrounding structures and height above the ground. Formula (2) can be assumed to provide a satisfactory practical resonant dipole antenna design. However, some fine-tuning may be required for absolute optimal performance.

To operate at frequencies outside designed resonant bandwidth, the frequency-dependent impedance of the antenna varies significantly from the resonant frequency impedance (typically 72 ohms). If there is a significant mismatch between antenna impedance and transmitter output impedances, power transfer from the transceiver to the antenna is degraded, resulting in lower communication efficiency. Additionally, the impedance mismatch causes a fraction of transmitted power to be reflected back to the transmitter resulting in overheating and potential damage to the transmitter final amplifier stage.

To overcome these difficulties, several alternatives have been commonly applied.

One solution is to connect multiple dipole conductive elements C to the same center conductor, referred to as a "fan" dipole A' (FIG. 2). In this type of antenna each pair of elements C in the "fan" is resonant at one specific frequency. Upon switching of frequencies, a different pair of elements becomes resonant. The disadvantage is that the "fan" dipole is difficult to erect due to the varying lengths and number of the wire elements. Additionally, from a practical perspective, this antenna can only be implemented to resonate on two or three discrete bands.

Another solution of the multi-band resonant dipole design is to use resonant traps. Traps consist of parallel inductor and capacitor networks. These networks are placed appropriately along the length of the dipole conductive elements. Progressively, as the resonant frequency of a pair of trap elements is realized, the trap appears as an open-circuit, thus shortening the electrical length of the antenna conductive elements. The disadvantage of this implementation is that the resonant traps are fairly bulky and heavy devices interspersed along the wire antenna conductive elements. Only a few specific frequency bands can be implemented with this design. One set of traps is required for each desired operating frequency.

A third option is to use an impedance matching network between the transmitter and the antenna. Instead of making the antenna resonant, an impedance matching network, consisting, typically of tunable inductors and capacitors, is adjusted to match the transmitter output impedance to the out-of-resonant antenna. These units usually work over a wide range of operating frequencies. The disadvantage with this method is that the matching network is another piece of equipment which must be carried along with the transmitter and the antenna.

There is thus a need for an antenna of simple and economical construction having conductive elements which can be adjusted to half-wavelength dimensions on any frequency within a selected range. There is further needed such an antenna as does not require an impedance matching network installed between the transceiver and the antenna conductive elements, does not require a multiplicity of antenna conductive elements to facilitate operations over a wide range of HF spectrum, and does not require an electrically or mechanically complex antenna assembly to facilitate operation over a wide range of the HF spectrum.

SUMMARY OF THE INVENTION

Accordingly, an object of the invention is to provide a simple and economical antenna assembly having conductive elements which are adjustable to half-wavelength on any frequency within a selected range and does not require impedance matching, a large number of antenna elements, or a complex structure or circuitry.

A further object of the invention is to provide such an antenna assembly which is portable, and is suitable for field and/or emergency operation.

With the above and other objects in view, as will hereinafter appear, a feature of the present invention is the provision of a multi-band, variable, high-frequency antenna comprising a pair of transmission lines for conveyance of signals from and to a transceiver, and braided copper conductors, each in electrical communication at a proximal end thereof with one of the transmission lines. Each of the braided copper conductors is mounted on a non-conductive support cord, the braided copper conductors being expandable and retractable along the support cords on which the conductors are mounted. A cord lock is proximate a distal end of each of the conductors for releasably locking the distal end of the conductor at a selected position on the support cord on which the conductor is mounted. Release of the cord locks permits lengthening and shortening of the braided copper conductors, and locking of the cord locks is operative to lock the conductors in place on the support cords to selectively fix a length of each of the conductors.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
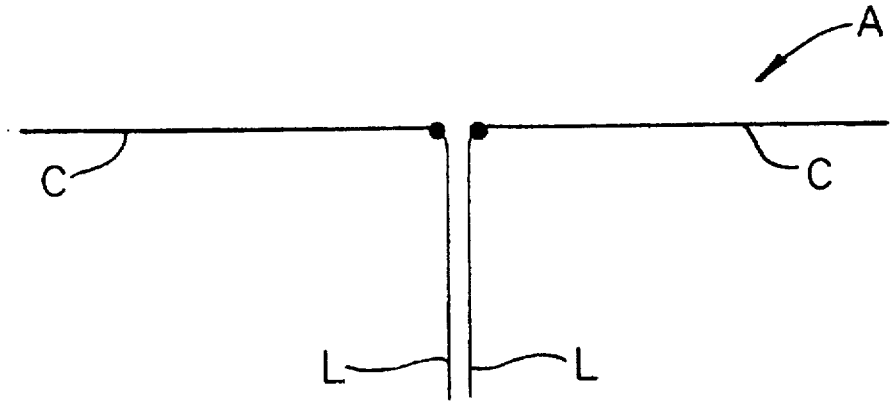
FIG. 1 PRIOR ART
FIG. 1 is a diagrammatic representation of a prior art simple dipole antenna.
Figure 2:
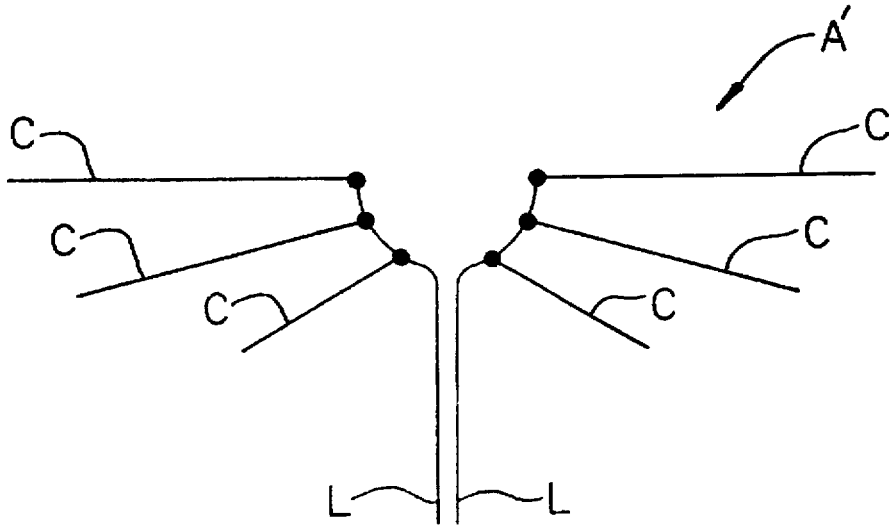
FIG. 2 PRIOR ART
FIG. 2 is a diagrammatic representation of a prior art fan dipole antenna.
Figure 3:
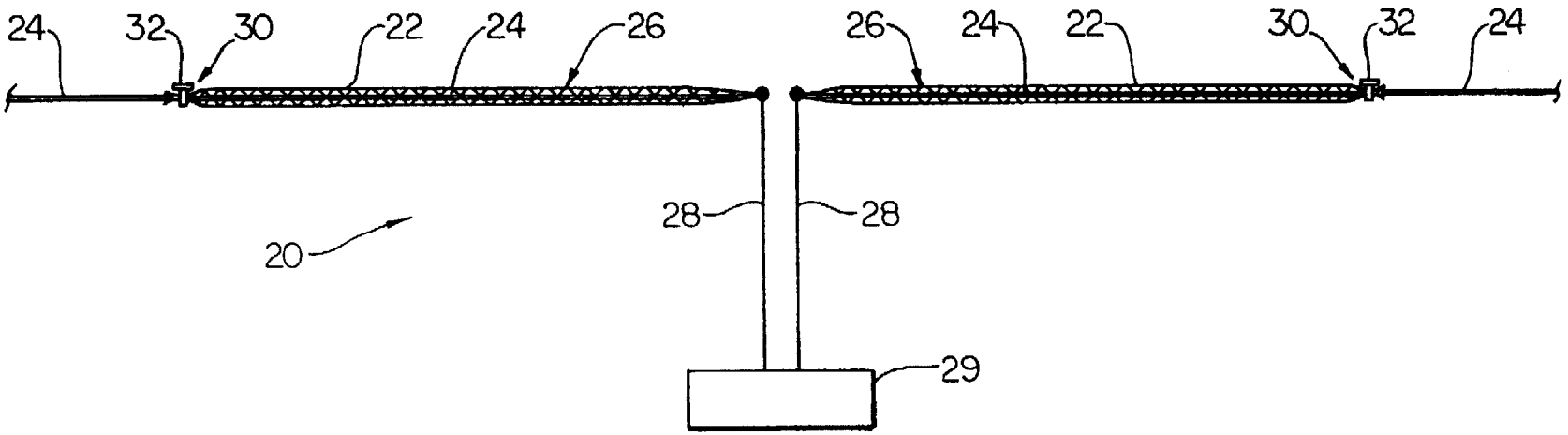
FIG. 3 is a diagrammatic representation of one form of antenna illustrative of an embodiment of the invention.
Figure 4:
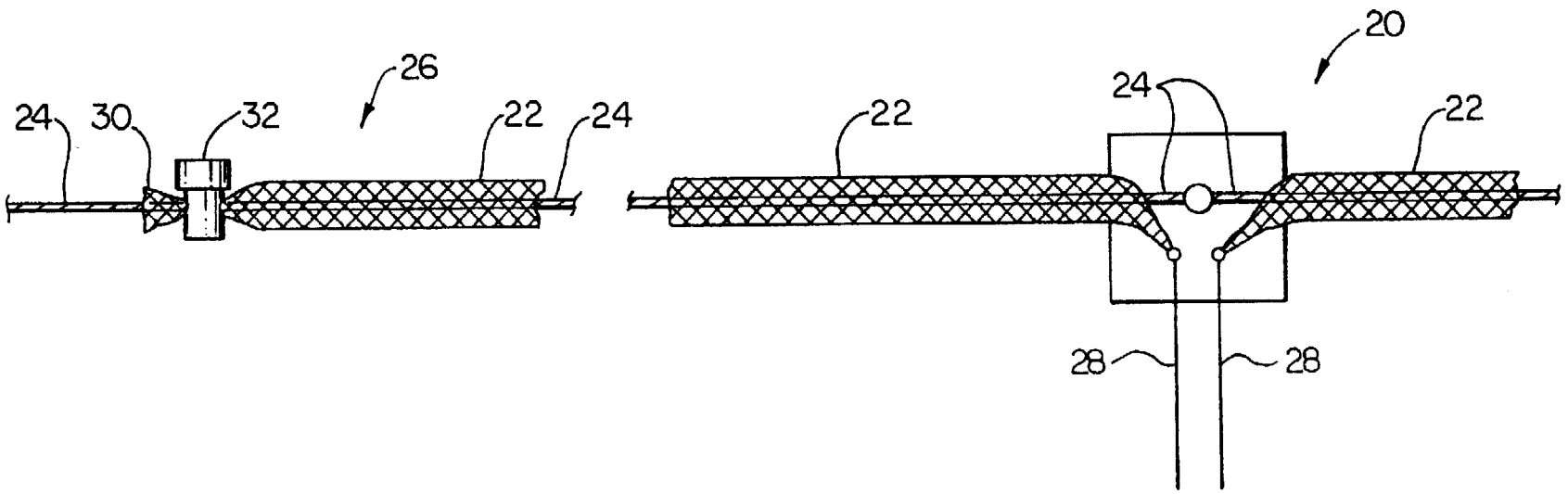
FIG. 4 is a further diagrammatic representation of one form of antenna illustrative of an embodiment of the invention.
Figure 4A:
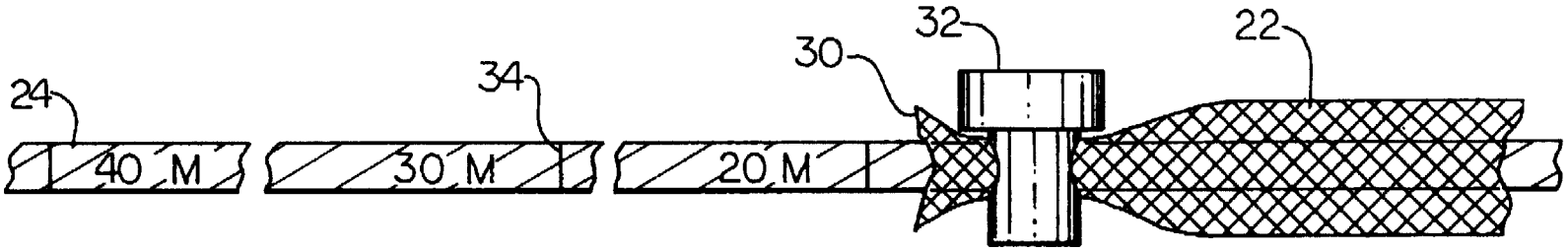
FIG. 4A is an enlarged review of a circled portion of FIG. 4.
Figure 5:
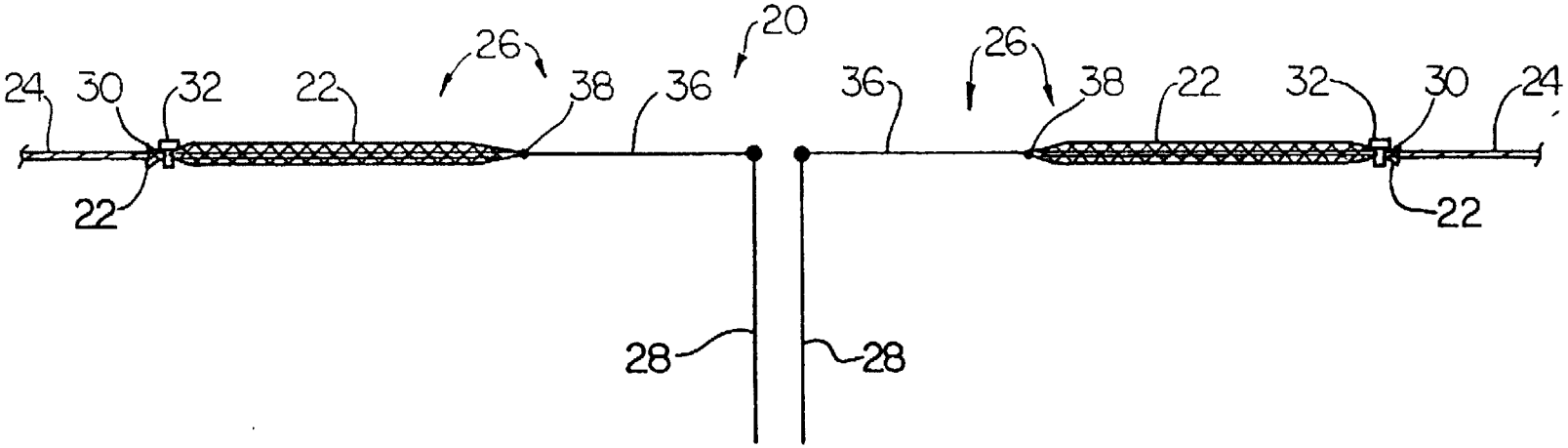
FIG. 5 is similar to FIG. 3, but illustrative of an alternative embodiment of the invention.
Figure 6:
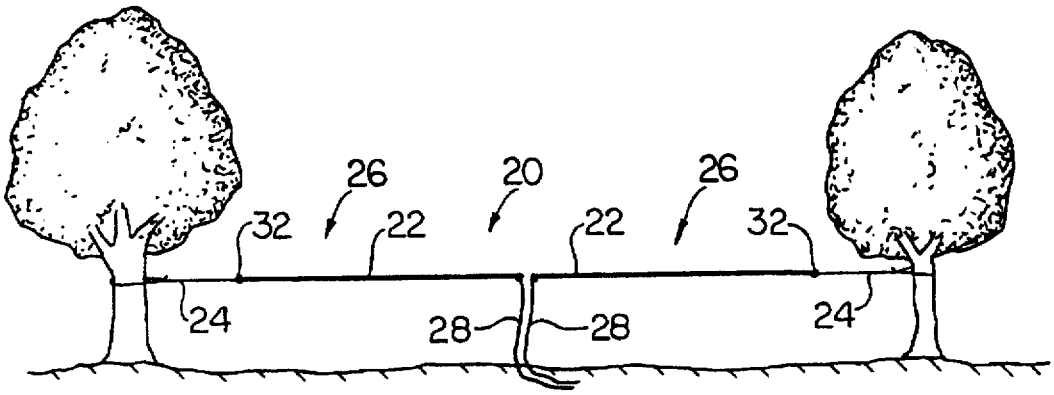
FIGS. 6–8 are illustrative of field uses of the invention.
Figure 7:
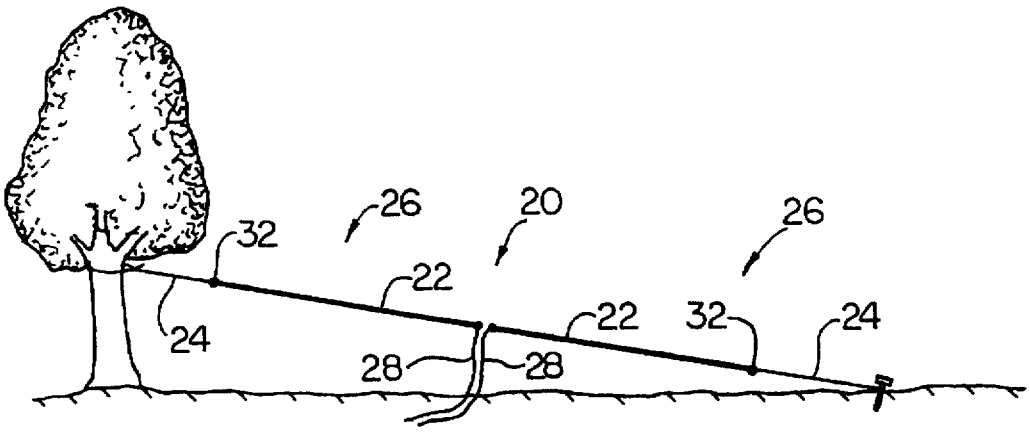
Figure 8:
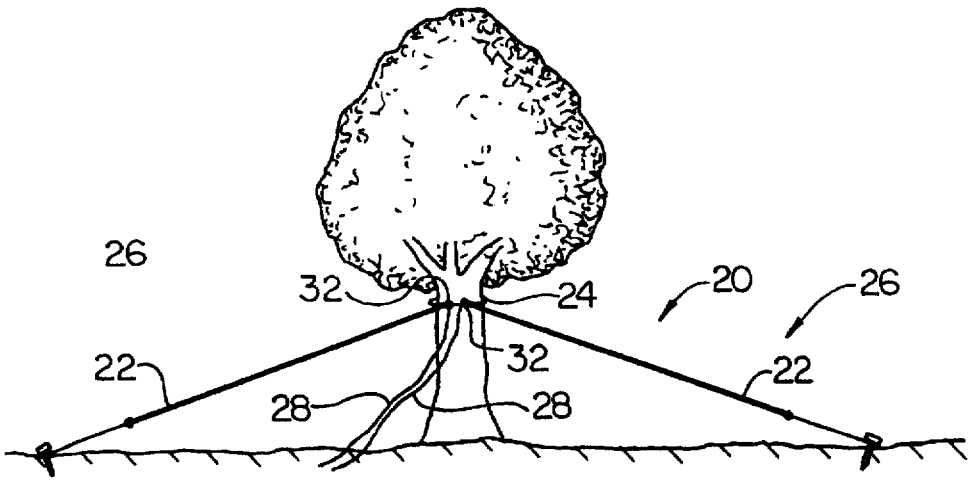

The multi-band, continuously variable, high-frequency antenna described herein solves many of the problems associated with the other methods of antenna matching techniques. In accordance with the present invention, an antenna 20 is provided (FIG. 3) with braided copper conductor elements 22 which can be axially stretched or retracted over a coaxial, internal non-conductive support cord 24. The braided copper conductors 22 serve as at least portions of antenna elements 26 and are in electrical communication with antenna transmission lines 28, similarly to the connection of a conventional resonant half-wave dipole antenna element C to a transmission line L. (FIG. 1). The transmission lines 28, in operation, are connected to a transceiver 29 (FIG. 3). Distal ends 30 of the braided copper elements 22 are clamped to the internal coaxial non-conductive support cord 24 with devices commonly known as "cord locks" 32 (FIGS. 3–8). Such cord locks 32 are spring-loaded and compress the braid 22 against the internal support cord 24. The cord locks 32 can be manually manipulated to release their tension on the copper braid elements 22 and internal support cord 24. Once the cord lock 32 is manually released, the braided copper conductor elements 22 can be axially stretched or retracted to a selected length to facilitate a resonant half-wave antenna element 26 for a specific operating frequency. The cord locks 32 facilitate easy manual adjustment of the lengths of the antenna elements 26. The support cord 24 can be provided with graduations 34 (FIG. 4A) to facilitate rapid and repeatable antenna tuning. The complete length of the antenna element 26 need not be fabricated with only the stretchable/compressible braided copper conductor element 22. The antenna element 26 can be configured with a fixed-length center element 36 (FIG. 5) that is resonant at the highest desired operating frequency. The stretchable/retractable braided copper conductor element 22 can be added to distal ends 38 of the center elements 36 to provide a complete antenna element 26 and facilitate resonant operation on lower frequencies. This concept can be applied to other antenna configurations, in addition to the resonant dipole antenna shown, where antenna tuning is desired.

The antenna described herein above can be deployed in the same manner as any common dipole antenna, and can be deployed in the field, as for military or emergency purposes. Typical installation configurations in field applications include "flat-top" (FIG. 6), sloping (FIG. 7), and inverted-V (FIG. 8) configurations.

It is to be understood that the present invention is by no means limited to the particular construction herein disclosed and/or shown in the drawings, but also comprises any modifications or equivalents within the scope of the claims.

Having thus described my invention, what I claim is new and desire to secure by Letters Patent of the United States is:

1. A multi-band, variable, high-frequency antenna comprising:

a pair of transmission lines for conveyance of signals from and to a transceiver;

a pair of braided copper conductor elements each in electrical communication at a proximal end thereof with one of said transmission lines;

each of said braided copper conductor elements being mounted on a non-conductive support cord;

said braided copper conductor elements being expandable and retractable along the support cords on which said conductor elements are mounted; and a cord lock proximate a distal end of each of said conductor elements for releasably locking said distal end of said conductor element at a selected position on said support cord on which said conductor element is mounted, release of said cord locks permitting lengthening and shortening of said braided copper conductor elements, and locking of said cord locks being operative to lock said conductor elements in place on said support cords to selectively fix a length of each of said conductor elements.

2. The antenna in accordance with claim 1 wherein said braided copper conductor elements each are connected to one of said transmission lines.

3. The antenna in accordance with claim 1, said antenna further comprising a pair of center elements each connected to one of said transmission lines, and wherein each of said braided copper conductor elements is connected at a proximal end thereof to one of said center elements to provide a center element and a braided conductor element in combination, and said locking of said conductor elements in place on said support cords selectively fixes a length of each of said center element and braided conductor element combinations.

4. The antenna in accordance with claim 1 wherein said support cords are provided with visible marks thereon for guidance as to available lengths of said braided copper conductor elements.

* * * * *